United States Patent [19]

Rager

[11] 4,065,987

[45] Jan. 3, 1978

[54] T LEVER ADAPTER

[75] Inventor: Charles L. Rager, Philadelphia, Pa.

[73] Assignee: The Raymond Lee Organization, Inc., New York, N.Y. ; a part interest

[21] Appl. No.: 775,710

[22] Filed: Mar. 9, 1977

[51] Int. Cl.[2] ..... B25G 1/00

[52] U.S. Cl. ..... 81/177 A; 81/177 G

[58] Field of Search ..... 81/177 R, 177 A, 177 D, 81/177 G, 177 PP, 177 ST, 177 N, 177 B, 184, 58.1; 145/61 L

[56] References Cited

U.S. PATENT DOCUMENTS

| | | | |
|---|---|---|---|
| 1,370,194 | 3/1921 | Cunha | 81/177 A |
| 1,459,708 | 6/1923 | Powers | 145/61 L |
| 2,675,840 | 4/1954 | Daiber | 145/61 R X |

*Primary Examiner*—Al Lawrence Smith
*Assistant Examiner*—Nicholas P. Godici
*Attorney, Agent, or Firm*—Daniel Jay Tick

[57] ABSTRACT

A handle member extends radially from a hollow cylindrical ring having a pair of spaced circular opposite edges. A trough-like member extends radially from the ring diametrically opposite the handle member and has a square U cross-section extending from an opening into the ring. A retainer piece is affixed to the handle member and extends beyond an edge of the ring for retaining the head of a ratchet device coaxially positioned in the ring with the handle member of the ratchet device accommodated for part of its length in the trough-like member. A keeper piece is removably affixed to the trough-like member for keeping the handle member of the ratchet device in the trough-like member.

2 Claims, 3 Drawing Figures

T LEVER ADAPTER

BACKGROUND OF THE INVENTION

The present invention relates to a T lever adapter. More particularly, the invention relates to a T lever adapter for a ratchet device having a cylindrical head with a pair of spaced substantially planar parallel bases, a handle member extending radially from the head and a projection extending axially from one of the bases of the head for accommodation in a socket.

Objects of the invention are to provide a T lever adapter of simple structure, which is inexpensive in manufacture, used with facility and convenience, removably installed with facility, convenience and rapidity in a ratchet device and functions efficiently, effectively and reliably to produce an equal turning force or torque about the axis of a standard ratchet wrench.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
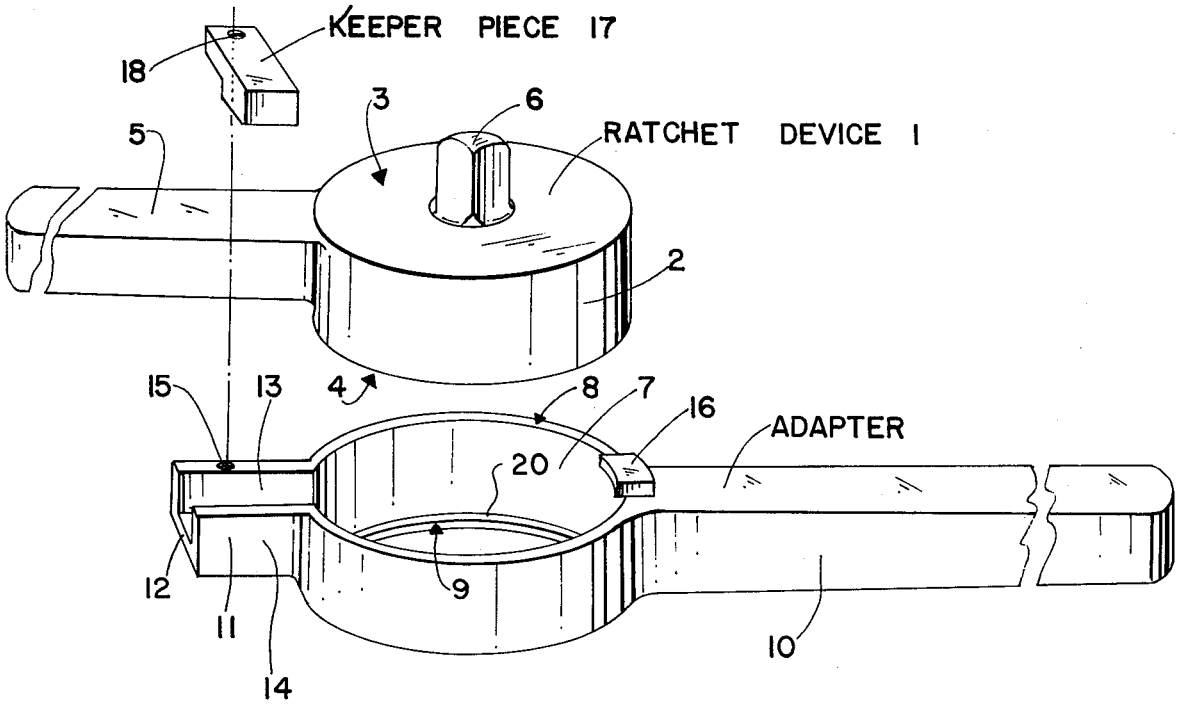
FIG. 1 is an exploded perspective view of an embodiment of the T lever adapter and a ratchet device with which it is used.

The T lever adapter of the invention is for a ratchet device or standard rachet wrench 1 having a cylindrical head 2 with a pair of spaced substantially planar bases 3 and 4 (FIG. 1). A handle member 5 extends radially from the head 2. A projection 6 (FIGS. 1 and 2) extends axially from the base 3 of the head 2 for accommodation in a socket whereby the ratchet device or wrench tightens or loosens an object in which the socket is formed.

The T lever adapter of the invention comprises a hollow cylindrical ring 7 (FIGS. 1 and 2) having a pair of spaced circular opposite edges 8 and 9 (FIG. 1).

Figure 2:
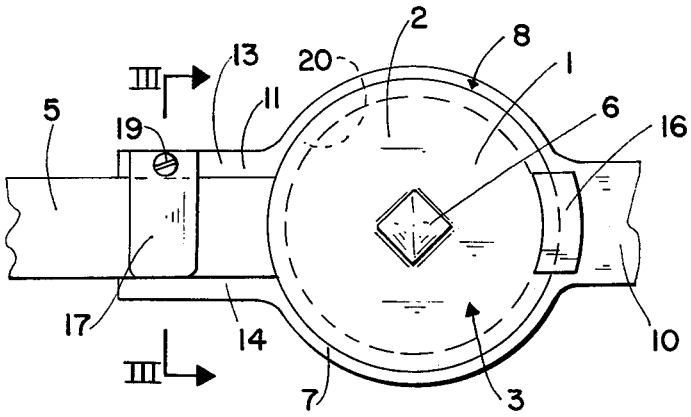
FIG. 2 is an axial view of the embodiment of FIG. 1 with a ratchet device accommodated therein.

A handle member 10 extends radially from the ring 7 (FIGS. 1 and 2).

Figure 3:
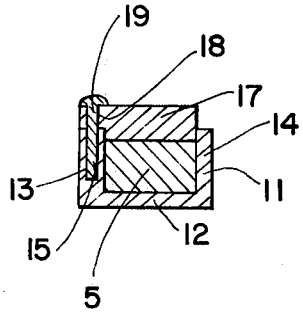
FIG. 3 is a cross-sectional view, taken along the lines III—III of FIG. 2.

A trough-like member 11 extends radially from the ring 7 diametrically opposite the handle member 10. The trough-like member 11 has a substantially square U cross-section extending from and opening into, the ring 7. The trough-like member 11 comprises a bottom 12 (FIGS. 1 and 3) having spaced opposite edges and a pair of spaced parallel sides 13 and 14 extending from the opposite edges of the bottom 12 (FIGS. 1 to 3). The side 13 has an internally threaded bore 15 formed therein (FIGS. 1 and 3).

A retainer piece 16 (FIGS. 1 and 2) is affixed to the handle member 10 and extends beyond the edge 8 of the ring 7 for retaining the head 2 of the ratchet device 1 coaxially positioned in the ring with the handle member 5 of said ratchet device accommodated for part of its length in the trough-like member 11.

A keeper piece 17 (FIGS. 1 to 3) is removably affixed to the trough-like member 11 for keeping the handle member 5 of the ratchet device 1 in said trough-like member. The keeper piece 17 comprises a plate member having a bore 18 (FIGS. 1 and 3) formed therethrough. The plate member is affixed to the side 13 of the trough-like member 11 via a screw or bolt 19 (FIGS. 2 and 3) extending through the bore 18 and threadedly coupled in the internally threaded bore 15 of the side 13.

The holding cavity illustrated in the example of FIGS. 1 and 2 is, as hereinbefore described, a hollow cylindrical ring 7. The hollow cylindrical ring 7 is one of a great variety of configurations of the holding cavity in which the ratchet is held by the adapter. Various commercially made rachets have different shapes.

A lip 20 extends inwardly from the edge 9 of the ring 7 and thus has a smaller diameter than that of said ring (FIGS. 1 and 2). The lip 20 assists in supporting the ratchet device 1 in the adapter.

While the invention has been described by means of a specific example and in a specific embodiment, I do not wish to be limited thereto, for obvious modifications will occur to those skilled in the art without departing from the spirit and scope of the invention.

I claim:

1. A T lever adapter for a ratchet device having a cylindrical head with a pair of spaced substantially planar parallel bases, a handle member extending radially from the head and a projection extending axially from one of the bases of the head for accommodation in a socket, said adapter comprising a hollow cylindrical ring having a pair of spaced circular opposite edges;

a handle member extending radially from the ring;

a trough-like member extending radially from the ring diametrically opposite the handle member, said trough-like member having a substantially square U cross-section extending from and opening into the ring;

a retainer piece affixed to the handle member and extending beyond an edge of the ring for retaining the head of a ratchet device coaxially positioned in the ring with the handle member of said ratchet device accommodated for part of its length in the trough-like member; and a keeper piece removably affixed to the trough-like member for keeping the handle member of the ratchet device in said trough-like member.

2. A T lever adapter as claimed in claim 1, wherein the trough-like member comprises a bottom having spaced opposite edges and a pair of spaced parallel sides extending from the opposite edges of the bottom, one of said sides having an internally threaded bore formed therein, and the keeper piece comprises a plate member having a bore formed therethrough and affixed to one of the sides for the trough-like member via a screw extending through the bore through the plate member and threadedly coupled in the internally threaded bore.

* * * * *